US006585566B2

(12) United States Patent
Takeda

(10) Patent No.: US 6,585,566 B2
(45) Date of Patent: Jul. 1, 2003

(54) METHOD FOR MANUFACTURING DIELECTRIC WAVE GUIDE

(75) Inventor: Toshikazu Takeda, Omihachiman (JP)

(73) Assignee: Murata Manufacturing Co. Ltd (JP)

( * ) Notice: Subject to any disclaimer, the term of this patent is extended or adjusted under 35 U.S.C. 154(b) by 58 days.

(21) Appl. No.: 09/843,656

(22) Filed: Apr. 26, 2001

(65) Prior Publication Data

US 2001/0045408 A1 Nov. 29, 2001

(30) Foreign Application Priority Data

Apr. 26, 2000 (JP) ..... 2000-125893

(51) Int. Cl.[7] ..... B24B 1/00

(52) U.S. Cl. ..... 451/29; 451/38; 451/39; 451/40; 29/829; 29/830

(58) Field of Search ..... 451/29, 30, 38, 451/39, 40; 29/829, 830

(56) References Cited

U.S. PATENT DOCUMENTS

| | | | | | |
|---|---|---|---|---|---|
| 4,237,606 | A | * | 12/1980 | Niwa et al. | 29/830 |
| 4,532,704 | A | * | 8/1985 | Green | 29/600 |
| 4,766,671 | A | * | 8/1988 | Sumi et al. | 359/885 |
| 4,920,640 | A | * | 5/1990 | Enloe et al. | 29/852 |
| 5,473,296 | A | | 12/1995 | Ishikawa et al. | 333/239 |
| 5,655,290 | A | * | 8/1997 | Moresco et al. | 29/830 |
| 5,894,252 | A | * | 4/1999 | Oida | 333/202 |
| 5,948,192 | A | * | 9/1999 | Ikuina et al. | 156/89.12 |
| 6,039,622 | A | * | 3/2000 | Kosaka et al. | 445/52 |
| 6,315,637 | B1 | * | 11/2001 | Apelgren et al. | 451/30 |
| 6,473,950 | B1 | * | 11/2002 | Kumakawa | 29/25.42 |

FOREIGN PATENT DOCUMENTS

| | | |
|---|---|---|
| EP | 0476954 | 3/1992 |
| EP | 1 065 745 | 6/2000 |
| EP | 1065745 | 1/2001 |
| GB | 2085660 | 4/1982 |
| JP | 6235281 | 7/1987 |
| JP | 06260814 | 9/1994 |
| JP | 10224120 | 8/1998 |

* cited by examiner

*Primary Examiner*—Joseph J. Hail, III
*Assistant Examiner*—Alvin J Grant
(74) *Attorney, Agent, or Firm*—Dickstein, Shapiro, Morin & Oshinsky, LLP

(57) ABSTRACT

A method for manufacturing a dielectric waveguide at a low manufacturing cost, the dielectric waveguide comprising a pair of conductor plates approximately parallel to each other and the dielectric strip provided therebetween, which can form a dielectric strip having accurate individual dimensions without generating cracks and chips during processing. The method comprises the steps of forming a resist pattern on a green sheet containing at least a powdered inorganic material and an organic binder, removing a predetermined amount of the green sheet corresponding to an opening in the resist pattern by the use of a mask, removing the resist pattern, and firing the green sheet. In the step of removing the predetermined amount of the green sheet, the rate of removal is continuously or intermittently changed along the depth direction of the green sheet.

13 Claims, 3 Drawing Sheets

METHOD FOR MANUFACTURING DIELECTRIC WAVE GUIDE

BACKGROUND OF THE INVENTION

1. Field of the Invention

The present invention relates to methods for manufacturing dielectric waveguides suitable for use in transmission lines and integrated circuits for use in the millimeter wave and microwave regions.

2. Description of the Related Art

Conventionally, a dielectric waveguide has a dielectric strip provided between a pair of conductor plates approximately parallel to each other for transmitting electromagnetic waves along the dielectric strip. In particular, a non radiative dielectric waveguide (hereinafter referred to as NRD guide) is a transmission waveguide having a small transmission loss in which a shielding area is formed by spacing a pair of conductor plates at a half or less of the wavelength of a transmitted wave so that no electromagnetic wave radiates from the dielectric strip. In the electromagnetic wave transmitting modes of the NRD guide, there are two types, i.e., an LSM mode and an LSE mode. The LSE mode, which has a smaller transmission loss, is generally used.

FIGS. 3 and 4 are cross-sectional views respectively showing two structures of conventional NRD guides. FIG. 3 shows the structure of a normal type NRD guide provided with a dielectric strip 53 between a pair of conductor plates 51, 52 disposed parallel to each other, which is disclosed in, for example, Japanese Examined Patent Application Publication No. 62-35281. FIG. 4 shows the structure of a so-called winged type NRD guide in which conductors 59, 60 are formed on external plane portions of dielectric strips 57, 58 having wing portions 55, 56, respectively, by a method, such as evaporation, or baking of silver paste, and in which the dielectric strip portions are disposed so as to oppose each other. The structure described above is disclosed in Japanese Unexamined Patent Application Publication No. 6-260814.

Compared to the normal type NRD guide, the winged type NRD has advantages in that the reproducibility of characteristics is superior, and the conductor and the dielectric strip thereof are easily aligned. In this connection, a synthetic resin, such as Teflon (registered trademark for PTFE, manufactured by E. I. du Pont de Nemours, Inc., U.S.A.), or a dielectric ceramic may be used, as the material for the dielectric strip. When a dielectric ceramic is used as a constituent material for the dielectric strip, since a dielectric ceramic generally has a higher relative dielectric constant than a synthetic resin, the bending loss can be decreased at a curved portion, and hence, miniaturization can be accomplished. Accordingly, development of dielectric strips using dielectric ceramics is currently progressed. The widths of the dielectric strips 57, 58, and the thicknesses of the wing portions 55, 56 are determined in accordance with the relative dielectric constant of a dielectric material to be used and the frequency of electromagnetic wave to be used. In general, when the relative dielectric constant is larger, and working frequency is higher, the widths w and the thicknesses t are decreased.

In a process for forming a winged type NRD guide as shown in FIG. 4 using a dielectric ceramic, a ceramic plate is preliminarily fired and polished, and then, as disclosed in Japanese Unexamined Patent Application Publication No. 10-224120, a plurality of green sheets having openings therein are laminated on the ceramic plate. Then, by firing the green sheet laminate, an NRD guide can be manufactured having a dielectric strip in a desired shape.

However, since a fired ceramic is very hard, a problem is that great time and effort are required for machining the fired ceramic plate so as to have a desired shape. In addition, since the thickness of the wing portion is small, another problem is that cracks and chips are likely to occur during machining.

In addition, in the method for laminating green sheets having openings therein, it is extremely difficult to accurately cut the green sheets in accordance with the width w of the dielectric strip and to accurately align the green sheets together. In the NRD guide used as a high frequency transmission waveguide in many cases, very high dimensional accuracy is required for the dielectric strip. Hence, there has been the problem in that the workability is poor.

SUMMARY OF THE INVENTION

Addressing these problems, the present invention provides a method for manufacturing a dielectric waveguide at lower manufacturing cost, in which the cracks and chips generated during machining in the conventional method are avoided, and in which a dielectric strip having accurate individual dimensions can be formed.

Through intensive research by the inventors of the present invention on the problems described above, it was discovered that the problems could be solved by a process comprising a step of forming a resist pattern on a green sheet containing a powdered inorganic material and an organic binder, a step of removing a predetermined amount of the green sheet corresponding to an opening of the resist pattern by the use thereof as a mask, a subsequent step of removing the resist pattern, and a step of firing the green sheet.

Thus, the present invention related to a method for manufacturing a dielectric waveguide including a pair of conductor plates approximately parallel to each other and a dielectric strip provided therebetween, in which the dielectric strip is formed by a process comprising a step of forming a resist pattern on a green sheet containing a powdered inorganic material and an organic binder, a step of removing a predetermined amount of the green sheet corresponding to an opening in the resist pattern by the use thereof as a mask, a step of removing the resist pattern, and a step of firing the green sheet.

According to the present invention, since it is not necessary to machine a fired hard ceramic plate as in the conventional example, and an unnecessary part of the green sheet is removed while it is in the green sheet state, cracks and chips are not generated, and thus, machining can be performed in a short period of time. In addition, since the dielectric strip is not formed by laminating a plurality of patterned thin green sheets, the conventional operation involving accurately aligning the green sheets is not required, and hence, the manufacturing process for the dielectric waveguide can be simplified. Furthermore, since a photolithographic technique which can perform accurate patterning can be applied to the patterning for the resist pattern, individual dimensions of the dielectric waveguide can be accurately defined, and hence, the dimensional accuracy can be significantly improved compared to the case in which the dimensions are defined by cutting.

For removing the green sheet, erosion processes can be used, such as sand blasting, slurry erosion, cavity erosion, sputtering, chemical milling, ion milling, and reactive ion etching (RIE). In this connection, "erosion" means a phenomenon in which the surface of a material is mechanically damaged by repetitive collisions (or impacts) of a fluid, and a part of the material is driven or plucked away ("Erosion and Corrosion," Japan Society of Corrosion Engineering Association, 1987, published by Shokabo Publishing Co., Ltd.). Among the processes mentioned above, sand blasting is most preferably used since a method using a vacuum process is not so suitable for performing fine machining of green sheets containing water and an organic component, and since high dimensional accuracy can be obtained by sand blasting in the formation of the dielectric strip which requires relatively deep etching, such as 0.2 to 1.0 mm.

In addition, when the green sheet is removed by a technique using erosion, the problem may arise in some cases in that side etching occurs when erosion progresses in the depth direction of the green sheet. That is, among the blasting particles contained in the fluid which collide with the surface of a material, some of the particles do not collide with the surface at right angles with respect to the surface of the material but rather have slanted incident angles and thereby are reflected toward the side of the surface of the green sheet. These particles etch the green sheet in the lateral direction thereof and thereby cause side etching. Furthermore, as the green sheet is removed in the depth direction, the part of the green sheet at which removal is performed at an initial stage is exposed to blasting particles for a longer period of time, whereby side etching is likely to occur particularly in the vicinity of the surface of the green sheet.

According to the present invention, side etching is constrained by using a green sheet in which the rate of removal by erosion is changed continuously or intermittently along the depth direction of the green sheet. That is, a part of the green sheet in the vicinity of the surface thereof, which is removed in an initial stage, is formed of a material having a high resistance to blasting compared to that inside the green sheet, in other words, the surface material has a low rate of removal by erosion, whereby the side etching is unlikely to occur even if the part of the green sheet described above is exposed to the blasting particles for a longer period of time.

With this continuously or intermittently changing rate of removal by erosion, the rate of removing the green sheet is gradually increased from the surface to the inside thereof along the depth direction. The change in rate of removal may be continuous or intermittent.

In order to change the rate of removal by erosion, there may be mentioned, for example, a method in which the content of a powdered inorganic material contained in the green sheet is changed along the depth direction thereof; a method in which the content of an organic binder contained in the green sheet is changed along the depth direction thereof; and the like.

In this connection, a step of removing the resist pattern and a step of firing the green sheet may be simultaneously performed. That is, when the green sheet is fired at a high temperature, the resist pattern may be removed by simultaneous pyrolysis thereof. As a result, the process can be simplified even more.

In addition, when the green sheet is removed by sand blasting or the like, in order to improve the workability and to prevent the deformation of the green sheet during the removing step, and the like, the removal is preferably performed after the green sheet is disposed on a fired hard ceramic base body. In the case described above, the ceramic base body can be the wing portion.

Other features and advantages of the present invention will become apparent from the following description of embodiments of the invention which refers to the accompanying drawings, in which like references denote like elements and parts.

DETAILED DESCRIPTION OF EMBODIMENTS OF THE INVENTION

First Embodiment

A method for manufacturing a dielectric waveguide is shown in FIGS. 1A to 1F. Ceramic green sheets 1, 2, 3, and 4, each containing a powdered inorganic material and an organic binder, are first prepared. The ceramic green sheets 1, 2, and 3, thus prepared are used for forming a dielectric strip portion by removing a predetermined amount thereof in a subsequent step. The ceramic green sheet 4 is to be used for forming a wing portion. In this embodiment, the case will be described in which a dielectric strip portion is formed of three layers of the ceramic green sheets; however, in order to obtain a desired thickness, the number of ceramic green sheets for forming a laminate is not limited to three layers.

As a powdered inorganic material used in this embodiment, glass or a ceramic, such as alumina, cordierite, forsterite, or spinel, may be used, and as long as machining accuracy and propagation characteristics are acceptable, any powdered inorganic material may be used. In this connection, compared to Teflon (trademark for PTFE), an inorganic material having a relative dielectric constant of 4 or more is preferably used since miniaturization can be accomplished. In addition, as an organic binder in this embodiment, a butyral resin, an acrylic resin, a urethane resin, an epoxy resin, a polyvinyl resin, or the like may be used. Any resin may be used as long as the resin is polished more easily than a resist material used in a subsequent step for removing a green sheet. In order to improve the adhesiveness and workability of the green sheets 1, 2, 3, and 4, a plasticizer, such as dioctyl phthalate, dibutyl phthalate, or $\alpha$-terpineol, may be added in addition to a powdered inorganic material and an organic binder. In addition, the ceramic green sheets 1, 2, and 3 are formed so that the rates of removal differ from each other in a subsequent step of removing a predetermined amount of the green sheets. As a method for differing the polishing rate, there may be mentioned a method in which the content of a powdered inorganic material is changed; and a method using different types of organic binders. However, if the same organic binder can be used, the step is made less complicated. Therefore, a method is more preferable in which the content of the powdered inorganic material is changed.

As a method for forming the green sheets 1, 2, 3, and 4, a doctor blade method, a comma coating method, a roll coating method, a casting method, or the like may be used. When the green sheets 1, 2, 3, and 4 are formed, the green sheets are formed having thicknesses of approximately several μm to several mm, and the thicknesses of the green sheets are preliminarily controlled so that a desired thickness (to form a dielectric strip capable of transmitting electromagnetic waves) can be obtained after firing.

Figure 1A:
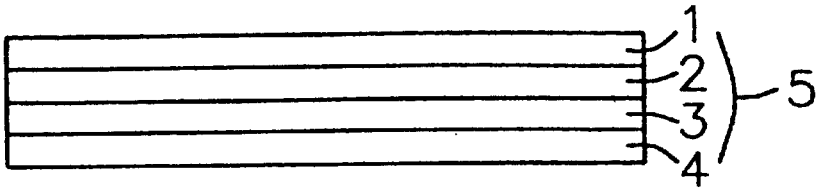
FIGS. 1A to 1F are cross-sectional views showing manufacturing steps in a method for manufacturing a dielectric waveguide according to an embodiment of the present invention.

Next, as shown in FIG. 1A, the green sheets 1, 2, 3, and 4 are laminated and compressed, thereby yielding a green sheet laminate (hereinafter referred to as a laminate) 5. In this step, a plurality of green sheets 4 may be included, for adjusting the thickness of the laminate. In addition, a green sheet like one of the green sheets 1, 2, and 3 is preferably used as the green sheet 4 since the same facility and the same molding conditions can be used therefor.

Figure 1B:
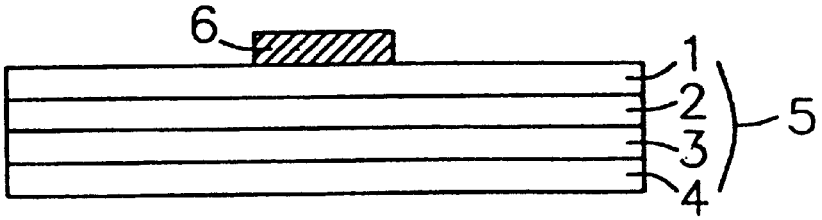

Next, a resist material is provided on the laminate 5, forming a resist pattern 6 which serves as a mask in a predetermined area for use in a photolithographic technique (FIG. 1B). The resist pattern 6 may be formed by a printing method or the like; however, a photolithographic technique is more preferably employed which can form a mask having a superior dimensional accuracy. As the resist pattern 6, any type of material may be used as long as the material has sufficient resistance to the conditions in a subsequent step of removing a predetermined part of the ceramic green sheets. In particular, polyvinyl alcohol, a polymethacrylate ester, a cellulose-based resin, poly-α-methyl styrene, a urethane resin, or the like may be used.

Figure 1C:
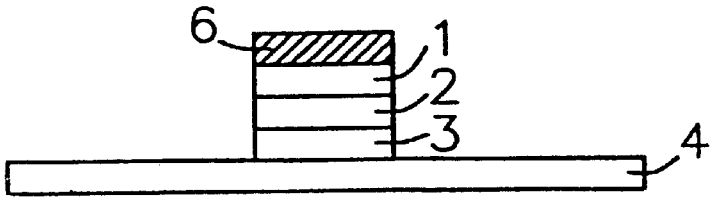

Next, the resist pattern 6 formed on the laminate 5 is used as a mask, and a predetermined amount of the ceramic green sheet is then removed by, for example, a sand blast method (FIG. 1C). In this step, as the sand blast method, a dry blast method may be used in which the green sheet corresponding to an opening of the mask is removed by blowing grinding particles with a gas; or a wet blast method may be used in which a green sheet is removed by blowing grinding particles with a liquid. As the grinding particles used for the sand blast method, alumina, silicon carbide, carbon, a rigid plastic, or the like may be used. Air, nitrogen, argon, or the like may be used as a gas, and water, ethyl alcohol, isopropyl alcohol, or the like may be used as a liquid.

Figure 1D:
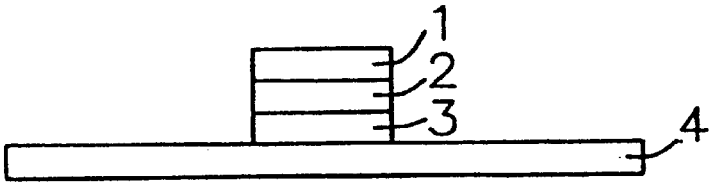

After the predetermined amount of green sheet is removed, the resist pattern 6 is removed (FIG. 1D). The resist pattern 6 may be removed by a removing method including a step of dissolving the resist pattern 6 by immersion thereof in a solvent; a method including a step of decomposing and burning the resist pattern 6 during a step of firing the laminate; and the like. Any method may be used as long as the method does not cause any deformation of the shape of the green sheet.

Figure 1E:
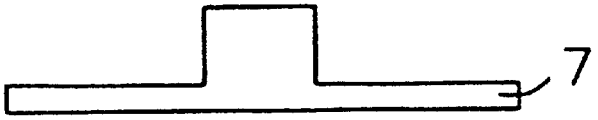

Next, the laminate 5 is fired after the resist pattern 6 is removed (or during the step of firing the laminate 5, the resist pattern 6 is simultaneously removed by burning), thereby yielding a fired dielectric ceramic body 7 (FIG. 1E). Firing may be performed in a non-oxidizing atmosphere or in an oxidizing atmosphere, and any general type of belt furnace, batch furnace, or the like may be used.

Figure 1F:
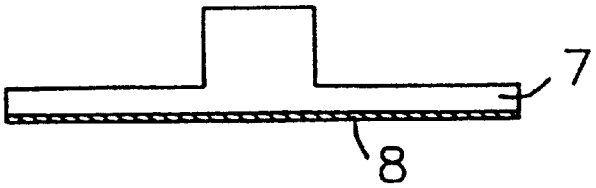

On the entire bottom surface of the fired ceramic body 7, a conductor 8 is formed by deposition (FIG. 1F). Then, a pair of the fired ceramic bodies 7 provided with the conductors 8 formed on the bottom surfaces thereof are disposed so that dielectric strip portions of the fired ceramic bodies 7 oppose each other, thereby yielding a dielectric waveguide having the structure shown in FIG. 4.

As described above, the conductor 8 is formed on the bottom surface of the fired ceramic body 7 by deposition after the fired ceramic body 7 is formed; however, the method for forming the conductor 8 is not limited thereto. For example, a method may be performed in which a conductive paste is formed by a printing method on the green sheet 4 or on the green sheet laminate 5 before firing; and the conductive paste is simultaneously fired when the laminate 5 is fired. In addition, after the laminate 5 is fired, a printing method, a sputtering method, a sol-gel method, a plating method, or the like may be performed for forming the conductor 8. Furthermore, the conductor 8 may be formed by adhering a conductive plate, such as a metal plate, to the bottom surface of the fired ceramic body 7.

Second Embodiment

In the method for manufacturing the dielectric waveguide described above, after the green sheets for forming the dielectric strip portion and the green sheet for forming the wing portion are laminated, compressed, and machined, these green sheets thus laminated are simultaneously fired; however, a method may also be used in which a green sheet is processed after the green sheet is disposed on a fired ceramic body used as the wing portion.

This second method for manufacturing the dielectric waveguide is shown in FIGS. 2A to 2H. In this method, except for the step of firing the green sheets used for the wing portion beforehand, the method may be the same as the first method for forming the dielectric waveguide described above. Accordingly, the same reference numerals designate the same materials, and descriptions thereof are omitted.

That is, ceramic green sheets 1, 2, 3, and 4 are first prepared each containing a powdered inorganic material and an organic binder. The ceramic green sheets 1, 2, and 3 thus prepared are used for forming a dielectric strip portion by removing a predetermined amount of the ceramic green sheets in a subsequent step, and the ceramic green sheet 4 is used for forming a wing portion.

Figure 2A:
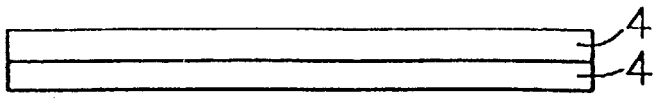
FIGS. 2A to 2H are cross-sectional views showing manufacturing steps in a method for manufacturing a dielectric waveguide according to another embodiment of the present invention.
Figure 2B:
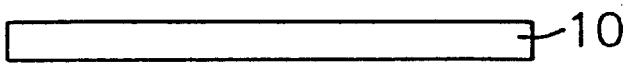
Figure 2C:
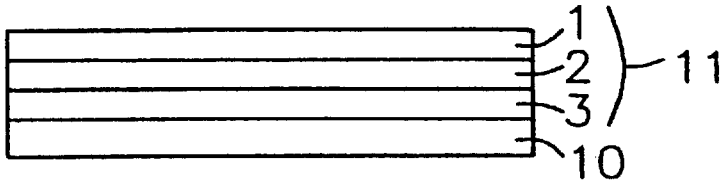
Figure 2D:
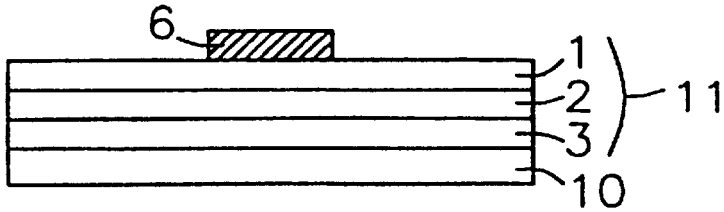
Figure 2E:
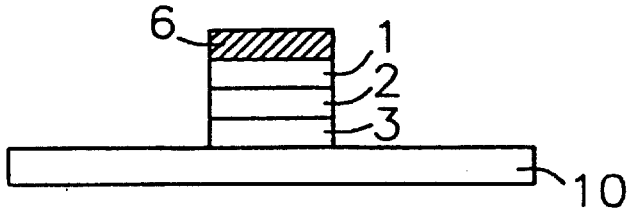
Figure 2F:
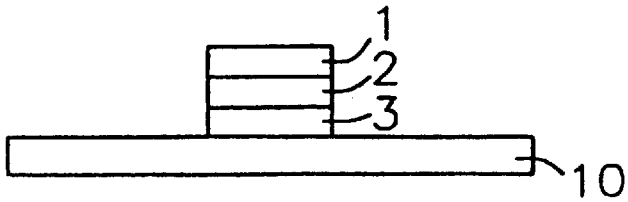

Next, as shown FIG. 2A, after a plurality of green sheets 4 are laminated and compressed, a ceramic base body 10 is formed by firing the plurality of green sheets 4 (FIG. 2B). Subsequently, as shown in FIG. 2C, a laminate 11 is formed by laminating and compressing the green sheets 1, 2, and 3, and the laminate 11 is disposed on the ceramic base body 10. Next, a resist pattern 6 is formed on the laminate 11 (FIG. 2D), the predetermined amount of the ceramic green sheets is removed by using the resist pattern 6 as a mask (FIG. 2E), and the resist pattern 6 is then removed (FIG. 2F).

Figure 2G:
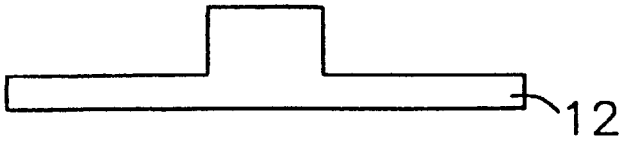
Figure 2H:
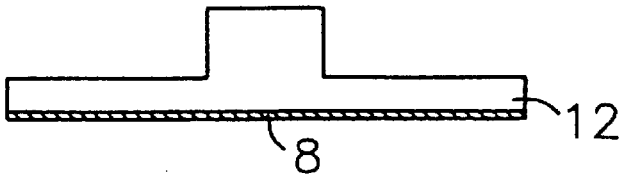
Figure 3:
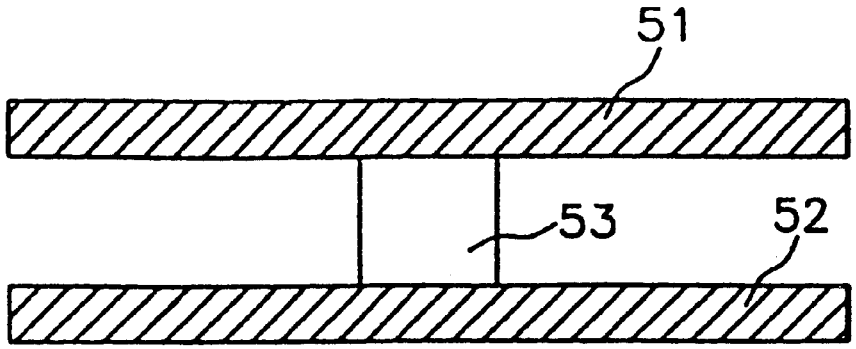
FIG. 3 PRIOR ART
FIG. 3 is a cross-sectional view showing the structure of a conventional dielectric waveguide.

Next, after the resist pattern 6 is removed, the laminate 11 is fired together with the ceramic base body 10 (or during the step of firing the laminate 10, the resist pattern 6 is simultaneously removed by burning), whereby a fired dielectric ceramic body 12 is obtained (FIG. 2G).

Figure 4:
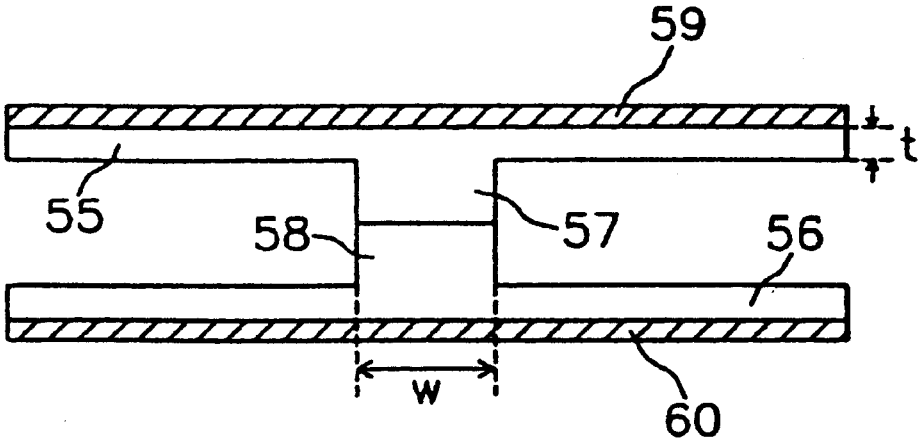
FIG. 4 PRIOR ART
FIG. 4 is a cross-sectional view showing the structure of another conventional dielectric waveguide.

Next, a conductor 8 is formed on the entire bottom surface of the fired ceramic body 12 by deposition (FIG. 2H), and in addition, a pair of the fired ceramic bodies 12 provided with the conductors 8 formed on the bottom surfaces thereof are disposed so that dielectric strip portions of the fired ceramic bodies oppose each other, thereby yielding a dielectric waveguide having the structure shown in FIG. 4.

As shown in the figures, the green sheets generally shrink when they are fired.

EXAMPLES

Hereinafter, the present invention will be described in detail with reference to the examples.

Example 1

Powdered spinel as a powdered inorganic material, butyral-based resin BM-2 as a plasticizer, and ethyl alcohol and toluene as an organic solvent were prepared and, after predetermined amounts thereof were weighed, were mixed in a polyethylene pot using a ball mill. Next, by a doctor blade method, three types of ceramic green sheets 10 to 100 μm thick were formed which have different content ratios of the powdered inorganic material from 55 to 60 percent by volume. The green sheets were cut to have a uniform shape of 70 by 70 mm, and a plurality of green sheets thus formed was laminated and compressed by hydrostatical isotropic pressing, thereby yielding a green sheet laminate. Considering one side of the green laminate to be an upper surface thereof, at least three green sheets from the upper surface were sequentially laminated having different content ratios of the powdered inorganic material in ascending order. Next, the green sheet laminate was heated to 80° C., Dry Film Resist BF-405 (manufactured by Tokyo Ohka Kogyo Co., Ltd.) was laminated on the upper surface of the laminate, and exposure using ultraviolet light was then performed on the laminate via a predetermined pattern mask. The exposure conditions were such that the wavelength was 365 nm and the exposure amount was 200 mJ/cm$^2$. Subsequently, by using an aqueous solution of sodium carbonate at a concentration of 0.3 wt %, a spray development is performed on the laminate at a solution temperature of 30° C. As a result, a resist pattern was obtained having an opening on the green sheet laminate.

Next, by using Pneuma Blaster SC-3 type (manufactured by Fuji Seisakusho K. K.), a predetermined amount of the green sheets corresponding to the opening in the resist pattern was removed by a sand blast method. The removal of the green sheets was performed for three green sheets from the upper surface of the laminate. In this step, the processing was performed under the conditions such that the distance between the nozzle and the green sheet was 8 cm, fused alumina #1000 was used as grinding particles, and the blasting pressure was 3 kg/cm$^2$. Subsequently, the laminate was immersed in an aqueous solution of monoethanolamine at a concentration of 10 wt % at a solution temperature of 45° C., the resist pattern was removed, and the laminate was then fired in a batch type electric furnace at 1,600° C. for 2 hours in the air, thereby yielding a dielectric strip having a wing portion shown in FIG. 4.

Every dielectric strip obtained in the example described above had no cracks and no chips at the wing portions thereof. In addition, the laminate was formed by laminating different types of green sheets, that is, at least three green sheets from the upper surface of the laminate were sequentially laminated having different content ratios of the powdered inorganic material in ascending order, and as sand blasting is performed along the upper surface to the third green sheet in the depth direction, the rate of removal of the green sheets is gradually increased. As a result, the side etching of the dielectric strip was satisfactory constrained, and the deviation (the standard deviation) of the width w of the dielectric strip was superior, such as 10 μm or less.

Example 2

As is the case in Example 1, powdered spinel as a powdered inorganic material, butyral-based resin BM-2 (manufactured by Sekisui Chemical Co., Ltd.) as an organic binder, dioctyl phthalate as a plasticizer, and ethyl alcohol and toluene as an organic solvent were prepared and, after predetermined amounts thereof were weighed, were mixed in a polyethylene pot using a ball mill. Next, by a doctor blade method, three types of ceramic green sheets 10 to 100 mm thick were formed, having different content ratios of the powdered inorganic material from 50 to 55 percent by volume. The green sheets were then cut to have a uniform shape of 70 by 70 mm, and a plurality of green sheets was laminated and compressed by hydrostatical isotropic pressing, thereby yielding a green sheet laminate. Considering one side of the green laminate to be an upper surface, at least three green sheets from the upper surface were sequentially laminated having different content ratios of the powdered inorganic material in ascending order. Next, on the upper surface of the green sheet laminate, a resist pattern composed of polyvinyl alcohol was formed having a predetermined pattern (an opening) by screen printing.

Next, as is the case in Example 1, a predetermined amount of the green sheets corresponding to the opening in the resist was removed by a sand blast method. The removal of the green sheets was performed for three green sheets from the upper surface of the laminate. Subsequently, without removing the resist pattern by using a solvent or the like, the laminate was fired in a batch type electric furnace at 1,600° C. for 2 hours in the air, and the resist pattern was simultaneously pyrolyzed, thereby yielding a dielectric strip having a wing portion shown in FIG. 4.

Every dielectric strip obtained in this example had no cracks and no chips at the wing portions thereof, and side etching of the dielectric strip was small. As a result, the deviation (the standard deviation) of the width w of the dielectric strip was superior, such as 10 μm or less.

Example 3

As is the case in Example 1, powdered spinel as a powdered inorganic material, butyral-based resin BM-2 (manufactured by Sekisui Chemical Co., Ltd.) as an organic binder, dioctyl phthalate as a plasticizer, and ethyl alcohol and toluene as an organic solvent were prepared and, after predetermined amounts thereof were weighed, were mixed in a polyethylene pot using a ball mill. Next, by a doctor blade method, ceramic green sheets 10 to 100 μm thick were formed. The green sheets were then cut to have a uniform shape of 70 by 70 mm, and a plurality of green sheets was laminated and compressed by hydrostatical isotropic pressing, thereby yielding a green sheet laminate. Subsequently, the laminate was fired in a batch type electric furnace at 1,600° C. for 2 hours in the air, thereby yielding a ceramic base body used as a wing portion.

Next, as is the case in Example 1, powdered spinel as a powdered inorganic material, butyral-based resin BM-2 (manufactured by Sekisui Chemical Co., Ltd.) as an organic binder, dioctyl phthalate as a plasticizer, and ethyl alcohol and toluene as an organic solvent were prepared and, after predetermined amounts thereof were weighed, were mixed in a polyethylene pot using a ball mill. Next, by a doctor blade method, three types of ceramic green sheets 10 to 100 μm thick were formed which have different content ratios of the powdered inorganic material from 50 to 55 percent by volume. The green sheets were then cut to have a uniform shape of 70 by 70 mm, and a plurality of green sheets was laminated and compressed by hydrostatical isotropic pressing, thereby yielding a green sheet laminate. Considering one side of the green laminate to be an upper surface, at least three green sheets from the upper surface were sequentially laminated having different content ratios of the powdered inorganic material in ascending order. Next, the bottom surface of the green sheet laminate was bonded to the ceramic base body described above.

Subsequently, by using a method equivalent to that in Example 1, a resist pattern having an opening therein was obtained on the green sheet laminate. Similarly, by using a method equivalent to that in Example 1, a predetermined amount of the green sheets corresponding to the opening in the resist was removed by a sand blast method. Furthermore, by using a method equivalent to that in Example 1, the resist pattern was removed, and the laminate thus formed was then fired in a batch type electric furnace at 1,600° C. for 2 hours in the air, thereby yielding a dielectric strip having the wing portion shown in FIG. 4.

Every dielectric strip obtained in this example had no cracks and no chips at the wing portion thereof, and side etching of the dielectric strip was small. In addition, the deviation (the standard deviation) of the width w of the dielectric strip was superior, such as 10 $\mu$m or less. Furthermore, by processing the green sheets after they were disposed on the fired ceramic base body, the deformation of the green sheets was prevented, and in addition, the workability thereof could be improved, whereby dielectric strips could be more easily manufactured.

As has thus been described, according to the method for manufacturing a dielectric waveguide of the present invention, the dielectric waveguide can be easily manufactured at low cost without generating cracks and chips during machining. In addition, since the rate of removal is gradually faster from the upper surface of the green sheet laminate towards the inside thereof in the depth direction, side etching of the dielectric strip can be sufficiently constrained, and hence, the dielectric strip can be accurately manufactured.

Although embodiments of the invention have been described herein, the invention is not limited thereto, but rather extends to all modifications and variations which would occur to those having the ordinary level of skill in the pertinent art.

What is claimed is:

1. A method for manufacturing a dielectric waveguide, the method comprising:

forming a resist pattern on a green sheet containing at least a powdered inorganic material and an organic binder;

removing a predetermined amount of the green sheet corresponding to an opening in the resist pattern by the use of the resist pattern as a mask;

removing the resist pattern; and firing the green sheet;

wherein the step of removing the predetermined amount of the green sheet includes the step of changing a rate of removal of the green sheet, continuously or intermittently, along a depth direction of the green sheet.

2. A method for manufacturing a dielectric waveguide, the method comprising:

disposing a green sheet containing at least a powdered inorganic material and an organic binder on a fired ceramic base body;

forming a resist pattern on the green sheet;

removing a predetermined amount of the green sheet corresponding to an opening in the resist pattern by the use of the resist pattern as a mask;

removing the resist pattern; and firing the green sheet, wherein the step of removing the predetermined amount of the green sheet includes the step of changing a rate of removal of the green sheet, continuously or intermittently, along a depth direction of the green sheet.

3. A method for manufacturing a dielectric waveguide according to claim 2, wherein the green sheet and the base body having the green sheet disposed thereon are formed of the same material.

4. A method for manufacturing a dielectric waveguide according to one of claims 1 to 3, wherein the content of the powdered inorganic material in the green sheet is changed continuously or intermittently in the depth direction thereof, thereby changing the rate of removal in the step of removing the predetermined amount of the green sheet.

5. A method for manufacturing a dielectric waveguide, according to claim 4, wherein the green sheet comprises a green sheet laminate formed by laminating a plurality of thin green sheet layers.

6. A method for manufacturing a dielectric waveguide according to claim 5, wherein the thin green sheet layers constituting the green sheet laminate are formed so that the content of the powdered inorganic material therein differ from each other, thereby changing the rate of removal in the step of removing the predetermined amount of the green sheet.

7. A method for manufacturing a dielectric waveguide according to claim 5, wherein the thin green sheet layers constituting the green sheet laminate are formed so as to have different rates of removal from each other, whereby the rate of removal in the step of removing the predetermined amount of the green sheet is changed.

8. A method for manufacturing a dielectric waveguide according to claim 7, wherein the thin green sheet layers constituting the green sheet laminate are formed so that the content of the powdered inorganic material therein differ from each other, thereby changing the rate of removal in the step of removing the predetermined amount of the green sheet.

9. A method for manufacturing a dielectric waveguide according to claims 1–3, wherein the green sheet comprises a green sheet laminate formed by laminating a plurality of thin green sheet layers.

10. A method for manufacturing a dielectric waveguide according to claim 9, wherein the thin green sheet layers constituting the green sheet laminate are formed so as to have different rates of removal from each other, whereby the rate of removal in the step of removing the predetermined amount of the green sheet is changed.

11. A method for manufacturing a dielectric waveguide according to claim 10, wherein the thin green sheet layers constituting the green sheet laminate are formed so that the content of the powdered inorganic material therein differ from each other, thereby changing the rate of removal in the step of removing the predetermined amount of the green sheet.

12. A method for manufacturing a dielectric waveguide according to claim 1, wherein the removal of the green sheet is performed by erosion.

13. A method for manufacturing a dielectric waveguide according to claim 1, wherein the step of removing the resist pattern and the step of firing the green sheet are performed simultaneously.

* * * * *